US006061942A

United States Patent [19]

Alvern

[11] Patent Number: 6,061,942

[45] **Date of Patent: *May 16, 2000**

[54] FLUID FILLER GUN DISPLAY DEVICE HAVING A PLACARD WITH A THREE-DIMENSIONAL IMAGE

[75] Inventor: Stein Alvern, Houston, Tex.

[73] Assignee: Alvern-Norway A/S, Norway

[ * ] Notice: This patent is subject to a terminal disclaimer.

[21] Appl. No.: 08/818,238

[22] Filed: Mar. 14, 1997

[51] Int. Cl.[7] ..... B67D 5/00

[52] U.S. Cl. ..... 40/642.02; 40/299.01; 222/23; 141/98

[58] Field of Search ..... 40/299, 661, 609, 40/611, 642.02, 299.01; 222/23; 141/392, 98, 200

[56] References Cited

U.S. PATENT DOCUMENTS

| | | | |
|---|---|---|---|
| 3,822,494 | 7/1974 | Zivica | 40/800 |
| 4,790,088 | 12/1988 | Morvant | 40/779 |
| 5,058,637 | 10/1991 | Fell | 141/392 |
| 5,184,655 | 2/1993 | Fell | 40/661 |

FOREIGN PATENT DOCUMENTS

| | | |
|---|---|---|
| 0411451 A2 | 7/1990 | European Pat. Off. . |
| WO 93/15493 | 8/1993 | WIPO . |

*Primary Examiner*—Cassandra H. Davis
*Attorney, Agent, or Firm*—Finnegan, Henderson, Farabow, Garrett & Dunner

[57] ABSTRACT

A display device is attachable to a fluid filler gun. A carrying body attaches to a gun head of the fluid filler gun. A frame attaches to an upper portion of the carrying body, the frame and an upper surface of the upper portion defining a display portion. A placard is removably mounted to the display portion. The upper surface of the placard presents a three-dimensional image. The image can either be a molded image projecting through an opening defined by the frame, an embossed image, or a hologram having a three-dimensional optical effect.

19 Claims, 5 Drawing Sheets

FLUID FILLER GUN DISPLAY DEVICE HAVING A PLACARD WITH A THREE-DIMENSIONAL IMAGE

BACKGROUND OF THE INVENTION

1. Field of the Invention

The present invention relates to a display device for a fluid filler gun. More particularly, the present invention relates to a display device for a fluid filler gun having a display placard with a 3-dimensional image.

2. Description of the Related Art

Filler gun display devices are known. A saddle or carrying body, usually made of pliable or rigid synthetic material, slides in place over a gun head of a fluid filler gun used with a filler pump, e.g., a gasoline pump, oil pump, water pump, or the like, typically provided at an automobile service station. The carrying body typically includes a display surface where replaceable display placards can be mounted.

The conventional display placards are flat cards made of paper, cardboard, plastic or the like. The conventional display placards have a variety of shapes, including circular, rectangular, and oval shapes, and are used for advertising a wide variety of products or services. The purpose of these placards is to attract the attention of the consumer operating the filler gun, and to persuade him or her to purchase the advertised product or service. The common feature of these flat display placards is that the advertised message is always presented in the form of a two-dimensional image.

Unfortunately, the conventional flat, two-dimensional display occasionally does not attract the attention of the consumer operating the filler gun. If the display does not draw the consumer's attention, the advertising message has no affect.

SUMMARY OF THE INVENTION

The present invention is provided to overcome one or more deficiencies in the conventional apparatus described above.

In accordance with the invention, a display device attaches to a fluid filler gun. The display device includes a carrying body removably attachable to a gun head of the filler gun, the carrying body including side portions and an upper portion having an upper surface. A frame attaches to the upper portion of the carrying body, the frame and the upper surface defining a display portion. A placard is removably mountable in the display portion, the placard having an upper surface presenting a three-dimensional image.

In order to define the three-dimensional image, the upper surface of the placard can be embossed with pictures or text. Alternatively, the surface can be raised by a molding process in three-dimensional images that project through an opening defined by the frame. In yet another embodiment, the placard can include a hologram, thereby defining the illusion of a three-dimensional image. The term "three-dimensional image" includes physical structures projecting in three dimensions from the placard, as well as optical illusions of three-dimensions created through holographic techniques or otherwise.

Preferably, the frame includes one or more studs projecting from an inner surface thereof, which engage apertures in the placard to hold the placard in place behind the frame. The frame itself can either be pivotally mounted to the upper portion of the carrying body, or can be removably mounted thereto.

It is further in accordance with the invention to provide a fluid filler gun, including a barrel, a gun head, and a handle.

The carrying body is included as an integral part of the upper portion of the gun head and defines an upper surface. A frame attaches to the upper surface of the gun head to define a display portion. A placard is removably mounted in the display portion, and includes an upper surface presenting a three-dimensional image.

Additional objects and advantages will be set forth in the description which follows, and in part will be understood from the description, or may be learned by practice of the invention. The objects and advantages may be obtained by means of the combinations set forth in the attached claims.

BRIEF DESCRIPTION OF THE DRAWINGS

The accompanying drawings, which are incorporated in and comprise part of the specification, illustrate preferred embodiments of the invention. Together with the general description given above and the detailed description given below, the drawings serve to explain the principles of the invention. In the drawings.

DETAILED DESCRIPTION OF THE PREFERRED EMBODIMENTS

Reference will now be made in detail to the present preferred embodiments of the invention as illustrated in the accompanying drawings.

Figure 1:
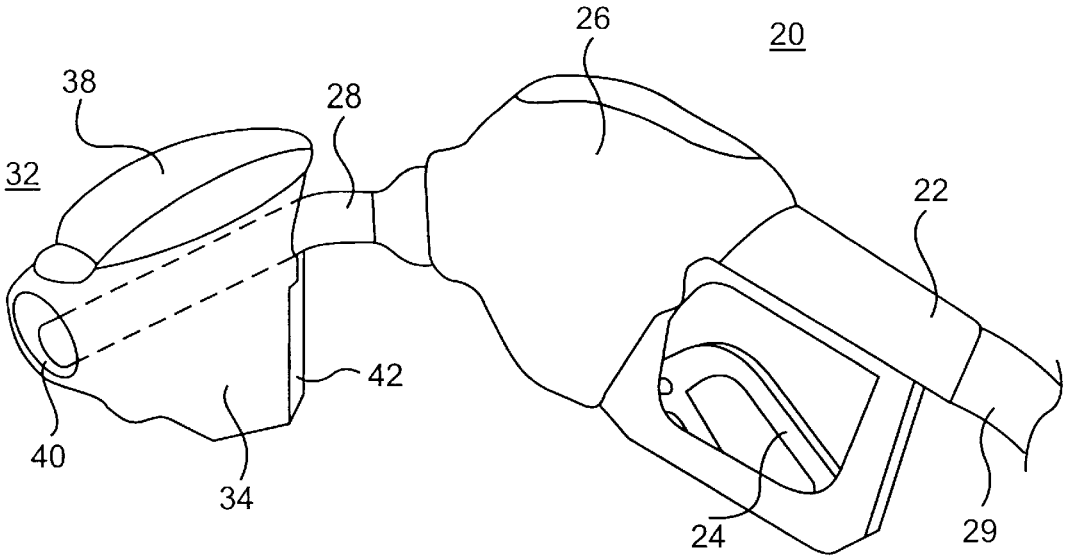
FIG. 1 is a perspective view depicting one embodiment of a carrying body being attached to a fluid filler gun in accordance with the invention.

A display device is attachable to a fluid filler gun. Referring to FIG. 1, a fluid filler gun 20 includes in sequence a handle 22, a gun head 26, and a barrel 28. A trigger 24 in handle 22 opens and closes a valve (not shown) in gun head 26 to pass fluid from a hose 29 to the barrel 28. The fluid filler gun 20 may have a number of shapes and configurations and typically is used in automobile service stations. A preferred filler gun 20 accordingly includes a gasoline filler gun, diesel filler gun, oil filler gun, washer fluid filler gun, or the like.

Figure 2:
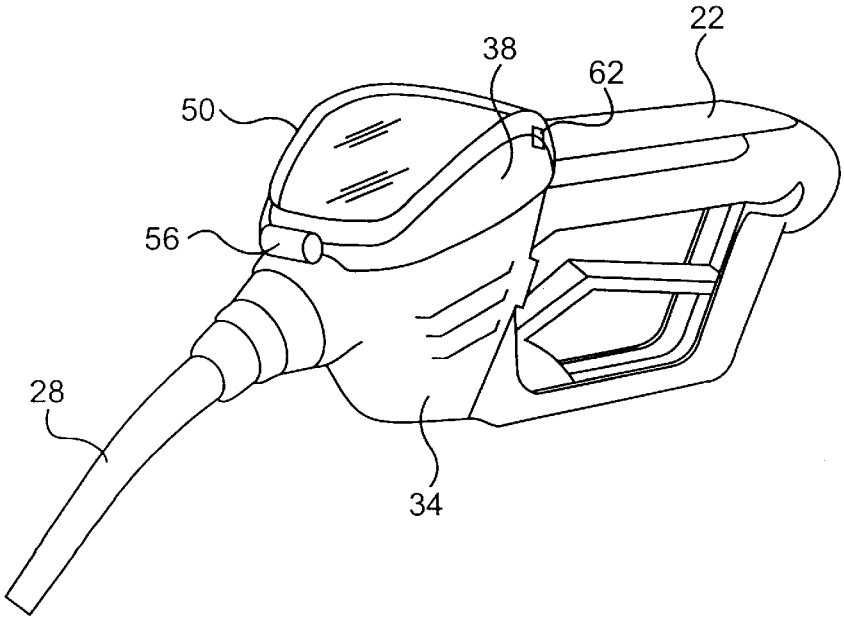
FIG. 2 is a perspective view depicting the carrying body of FIG. 1 fully attached to the fluid filler gun.

A preferred display device includes the following components. A carrying body removably attaches to the gun head and includes side portions and an upper portion. As shown in FIGS. 1 and 2, a carrying body 32 includes side portions 34 and 36 (not shown), molded as an integral component, and an upper portion 38. Upper portion 38 can either be molded as an integral component with the side portions 34, 36, or can be a separate piece snapped into place on side portions 34, 36. As shown in FIGS. 1 and 2, carrying body 32 slides into place on gun head 26, with gun barrel 28 projecting through a front opening 40, and handle 22 projecting through a rear opening 42. Carrying body 32 preferably is made of a rigid material. More preferably, carrying body 32 is made of a rigid plastic.

Figure 3:
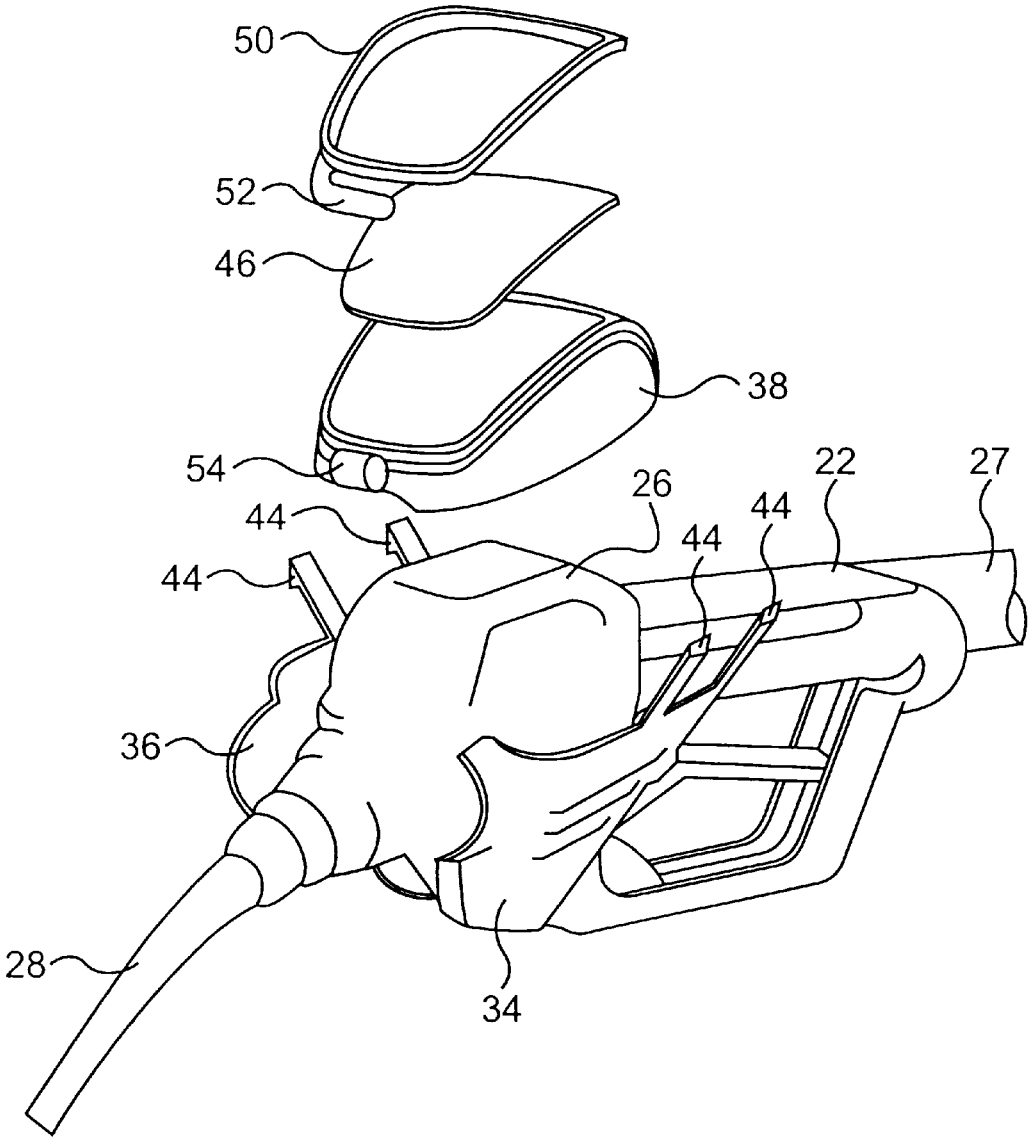
FIG. 3 is an exploded perspective view of another embodiment of a carrying body in accordance with the invention being attached to a fluid filler gun.

Alternatively, as shown in FIG. 3, side portions 34 and 36 can be provided as two separate pieces that snap together around gun head 26. Male projections 44 are provided at the upper edges of side portions 34 and 36 for engaging female connections in the upper portion 38.

Other embodiments of carrying body 32 are also possible. For example, side portions 34 and 36 are shown joined together beneath gun head 26 in FIGS. 1–3, but side portions 34, 36 also can be open at the bottom, or joined together by straps passing beneath gun head 26. The invention is not limited to any particular configuration of carrying body 32.

Persons skilled in the art will recognize that gun head 26 often is covered with a flexible rubber or plastic boot. The flexible boots are provided with gasoline filler guns to protect the paint on an automobile when the filler gun is inserted into an automobile gas tank. The carrying body 32 accordingly is dimensioned so that it can attach to or slide over a gun head 26 with the flexible boot either in place or removed.

The upper portion 38 of carrying body 32 includes an upper surface 46. Preferably, upper surface 46 is arcuate in shape from front to rear when viewed from the side, but this shape is not required. Upper surface 46 can be planar or angled as well.

Figure 4:
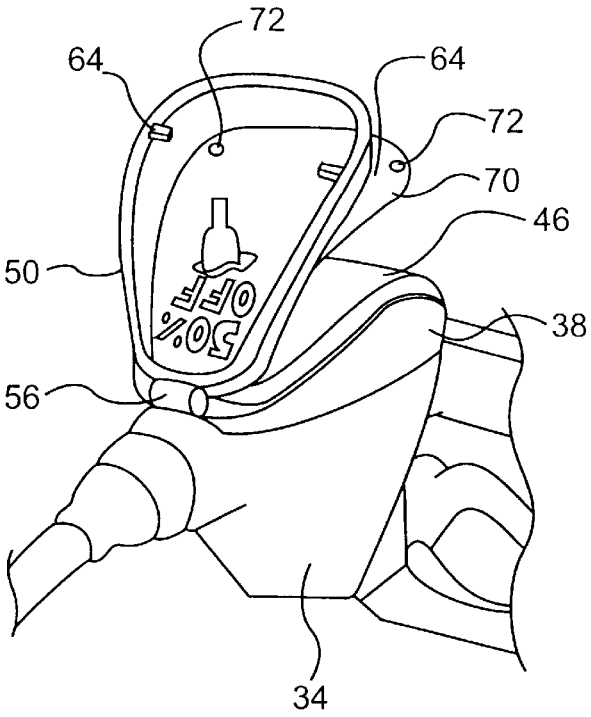
FIG. 4 is a perspective view depicting a pivotal attachment of a frame to an upper portion of a carrying body in accordance with the invention.
Figure 5:
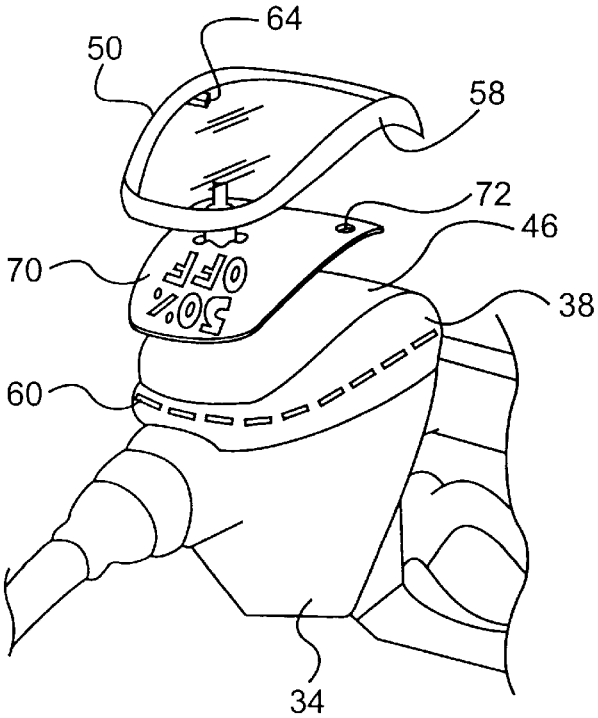
FIG. 5 is a perspective view depicting a removable attachment of a frame to an upper portion of a carrying body in accordance with the invention.

In accordance with the invention, a frame attaches to the upper portion of the carrying body. The frame and the upper surface of the carrying body defines a display portion. As shown in FIGS. 2, 3, 4 and 5, a frame 50 is provided, which attaches to upper portion 38 of carrying body 32. In FIGS. 2, 3 and 4, frame 50 pivotally attaches to upper portion 38 via insertion of a male member 52 into a female member 54, defining a hinge 56. In FIG. 5, frame 50 removably attaches to upper portion 38 by engagement of a skirt 58 depending from frame 50 with a lip 60 projecting from the periphery of upper portion 38.

Figure 6:
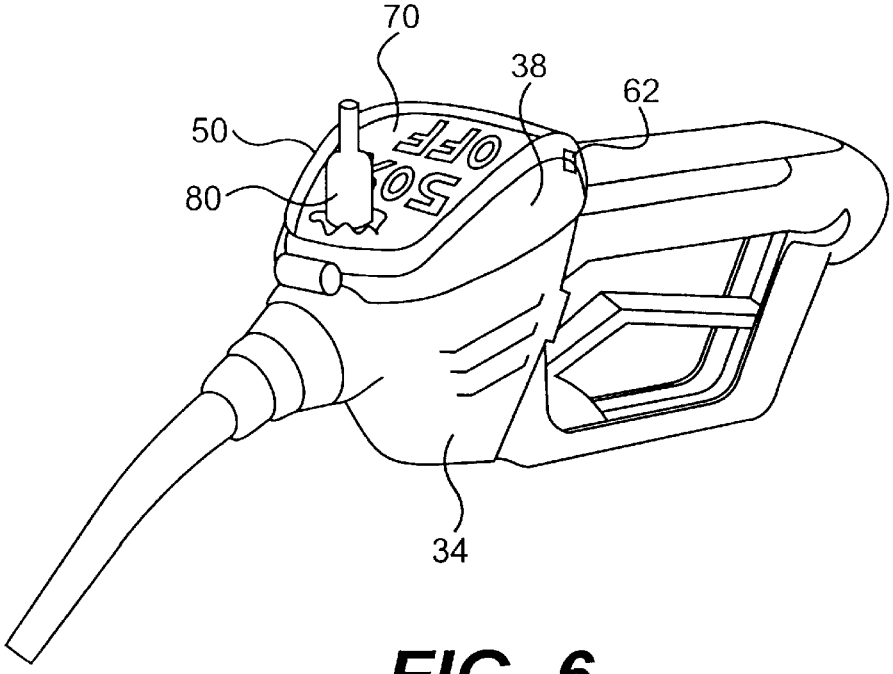
FIG. 6 is a perspective view depicting a display device having a display placard in accordance with the invention with a three-dimensional image projecting between the edges of the frame.
Figure 7:
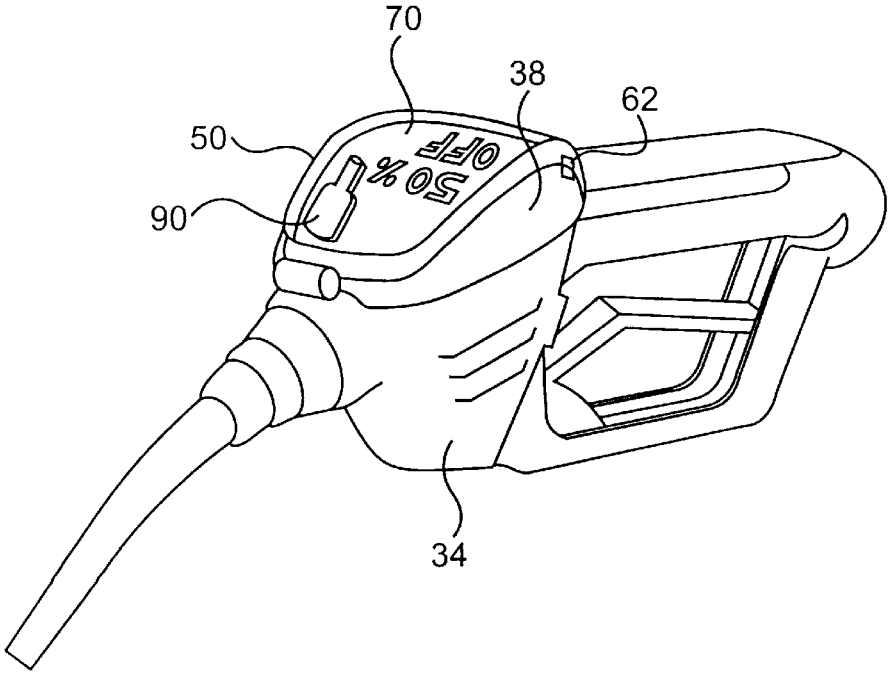
FIG. 7 is a perspective view depicting a display device having a display placard in accordance with the invention having a three-dimensional image created by embossing or by a holographic technique.

It is preferred that a locking device be provided for locking the frame to the carrying body. Referring to FIGS. 2, 6, and 7, a locking device 62 is provided to hold frame 50 closed against upper portion 38 of carrying body 32. The locking device 62 can be any of the conventional locking devices that are well known in the art, and can either be operated by hand, with a tool such as a screwdriver, or with a special key.

Preferably, frame 50 is configured with one or more studs 64 projecting from an inner surface thereof, as shown, e.g., in FIGS. 4 and 5. The function of studs 64 will be explained below.

In accordance with the invention, a placard is removably mountable on the display portion, said placard having an upper surface presenting a three-dimensional image. As shown in FIGS. 4, 5, 6, and 7, a replaceable display placard 70 mounts between upper surface 46 of upper portion 38, and the inner surface of frame 50. Preferably, one or more apertures are provided near the edges of placard 70 so that studs 64 on the inner surface of frame 50 can insert therethrough, mounting the placard 70 in a fixed position to the inner surface of frame 50. However, it is not necessary to provide the studs 64 and apertures 72, because placard 70 can be held in place by the simple engagement of frame 50 with upper portion 38.

The upper surface of placard 70 defines a three-dimensional image. As shown in FIG. 6, for example, a three-dimensional image 80, which may include pictures, text, or both, projects outward from placard 70, projecting through an opening defined by the sides of frame 50. In the embodiment of FIG. 6, it is preferred that placard 70 be made of a plastic or rigid cardboard material, and that three dimensional image 80 is formed in the upper surface of placard 70 by a conventional molding process, molding the image 80 into the surface of placard 70.

Alternatively, as shown for example in FIG. 7, a three dimensional image 90 may be provided in the upper surface of placard 70. In this embodiment, the three-dimensional image, which again may include pictures, text, or both, is created in placard 70 by an embossing technique, creating characters and pictures raised above the surface of placard 70, or by a holographic technique that creates the optical illusion of three-dimensions above placard 70. Both embossing and holographic techniques are well known in the art.

In either embodiment, the image 80 or 90 projects above the surface of placard 70, or gives the illusion of projecting above the surface in the case of a hologram, creating a three-dimensional image that is more noticeable to a consumer than a conventional flat, two-dimensional image. For example, when an image of a beverage bottle is to be advertised on a placard 70, it is preferred to use the exact shape of the commercial embodiment of the beverage bottle. Certain beverage bottles have very distinct shapes, instantly recognized by consumers. A three-dimensional image having the distinctive shape of the commercial product being advertised will clearly attract the attention of the consumer operating the filler gun.

In the above-described embodiments, carrying body 32 releasably attaches to filler gun 20. The invention is not limited to detachable display devices, however. It is within the scope of the invention to provide the three dimensional advertising display in a display device that is an integral part of the gun head itself.

Figure 8:
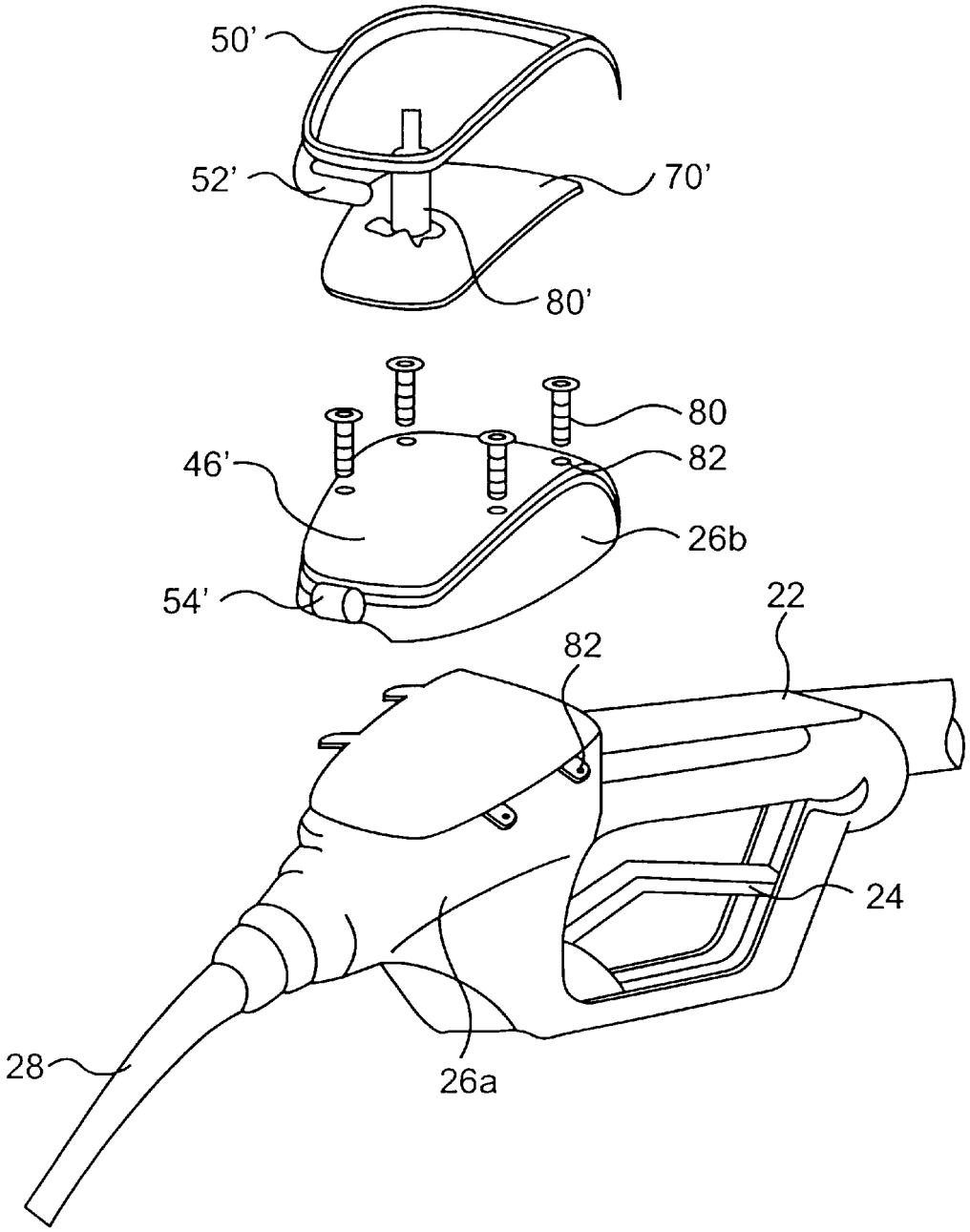
FIG. 8 is an exploded perspective view of a fluid filler gun having an integral display portion, with a placard having a three-dimensional image.

As shown in FIG. 8, gun head 26 includes a lower portion 26*a*, comprising the side portions, and an upper portion 26*b*, corresponding to an upper portion 38 of the detachable carrying body 32 of the previous embodiments. In the embodiment of FIG. 8, upper portion 26*b* attaches to lower portion 26*a* via insertion of threaded fasteners 80 in apertures 82, but this type of attachment is not required. Upper portion 26*b* and lower portion 26*a* can be welded together or formed as an integral unit.

In the embodiment of FIG. 8, a frame 50' pivotally attaches to upper portion 26*b* via insertion of male member 52' into female member 54'. An upper surface 46' is defined on the upper portion 26*b* of gun head 26. A replaceable placard 70' is mountable between frame 50' and upper surface 46'. The placard 70' includes an upper surface having a three dimensional image, e.g. molded image 80' in FIG. 8, projecting therefrom. Embossed or holographic three-dimensional images 90' also can be provided.

Additional advantages and modifications will readily occur to persons of ordinary skill in the art. The invention, therefore, is not limited to the specific details or the present preferred embodiments disclosed above. Departures may be made from such details without departing from the scope of the invention concept. The scope of the invention is limited only by the attached claims and their equivalents.

What is claimed is:

1. A display device attachable to a fluid pump filler gun, the filler gun including a barrel, a gun head, and a handle, the display device comprising:

a carrying body removably attachable to the gun head, said carrying body including an upper portion for covering an upper part of the gun head, said upper portion of said carrying body having an upper surface;

a frame attached to the upper portion of said carrying body, said frame and the upper surface defining a display portion; and a placard removably mountable on said display portion, said placard having an upper surface presenting a three-dimensional image, wherein the upper surface of said placard includes a hologram defining the three-dimensional image.

2. The display device of claim 1, wherein said frame pivotally attaches to the upper portion of said carrying body.

3. The display device of claim 1, wherein said frame removably attaches to the upper portion of said carrying body.

4. The display device of claim 1, wherein said frame has an inner surface and a stud projecting from the inner surface, said stud being insertable through an aperture proximate an edge of said placard.

5. The display device of claim 1, wherein said carrying body includes a locking device for locking said frame to the upper portion of said carrying body.

6. The display device of claim 1, wherein said carrying body further includes side portions for covering side parts of the gun head.

7. The display apparatus of claim 1, wherein said carrying body is slidably attachable onto the gun head.

8. The display device of claim 1, wherein said carrying body upper portion is configured to be bolted directly to the upper part of the gun head order to be attached to the gun head.

9. A display device attachable to a fluid pump filler gun, the filler gun including a barrel, a gun head having sides and an upper part, and a handle, the display device comprising:

a carrying body removably attachable to the gun head, said carrying body including generally rigid side portions and a generally rigid upper portion joined together and configured to substantially surround the sides and the upper part of the gun head when said carrying body is attached to the gun head, said upper portion of said carrying body having an upper surface, said upper surface configured to extend generally in an arc between the barrel and the handle of the filler gun when said carrying body is attached to the gun head;

a frame having an opening, said frame attached to said upper portion of said carrying body, said frame and said upper surface defining a display portion; and a placard removably mountable on said display portion, said placard having an upper surface presenting a three dimensional image projecting through said opening of said frame;

wherein said side portions and said upper portions are separate pieces snapped together to define said carrying body.

10. The display device of claim 9, wherein said frame pivotally attaches to the upper portion of said carrying body.

11. The display device of claim 9, wherein the image on said placard is an embossed image.

12. The display device of claim 9, wherein said frame has an inner surface and a stud projecting from the inner surface, said stud being insertable through an aperture proximate an edge of said placard.

13. The display device of claim 9, wherein said carrying body is slidably attachable onto the gun head.

14. The display device of claim 9, wherein said frame removably attaches to said upper portion of said carrying body.

15. The display device of claim 9, wherein said carrying body includes a locking device for locking said frame to said upper portion of said carrying body.

16. The display device of claims 6 or 9, wherein said side portions and said upper portion are molded together as an integral unit.

17. The display device of claims 6 or 9, wherein said side portions and said upper portion are separate pieces snapped together to define said carrying body.

18. A display apparatus, comprising:

a fluid filler gun including a barrel, a gun head having sides and an upper part, and a handle;

a carrying body removably attached to said gun head, said carrying body including generally rigid side portions and a generally rigid upper portion joined together and covering said sides and said upper part of said gun head, said upper portion of said carrying body having an upper surface, said upper surface extending generally in an arc between the barrel and the handle of said filler gun;

a frame having an opening, said frame attached to said upper portion of said carrying body, said frame and said upper surface defining a display portion; and a placard removably mountable on said display portion, said placard having an upper surface presenting a three-dimensional image projecting through said opening of said frame;

wherein said side portions and said upper portions are separate pieces snapped together to define said carrying body.

19. A display device attachable to a fluid pump filler gun, the filler gun including a barrel, a gun head having sides and an upper part, and a handle, the display device comprising:

a carrying body removably attachable to the gun head, said carrying body including generally rigid side portions and a generally rigid upper portion joined together and configured to substantially surround the sides and the upper part of the gun head when said carrying body is attached to the gun head, said upper portion of said carrying body defining an upper surface;

a frame having an opening, said frame attached to said upper portion of said carrying body, said frame and said upper surface defining a display portion; and a placard removably mountable on said display portion, said placard having an upper surface presenting a three-dimensional image;

wherein said side portions and said upper portions are separate pieces snapped together to define said carrying body.

* * * * *